United States Patent [19]

Haś et al.

[11] 4,165,867

[45] Aug. 28, 1979

[54] INSTALLATION FOR NITRIDING-SULPHIDIZING OF STEEL AND IRON ELEMENTS

[75] Inventors: Zdzisław Haś; Jerzy Gramsz; Wojciech Jarosz, all of Łódź; Piotr Jaremczuk, Świebodzin; Stanisław Bruszewski, Świebodzin; Krzysztof Koczela, Świebodzin, all of Poland

[73] Assignees: Politechnika Lodzka, Zwirki; Lubuskie Zaklady Termotechniczne, Świebodzin, both of Poland

[21] Appl. No.: 775,639

[22] Filed: Mar. 8, 1977

Related U.S. Application Data

[63] Continuation of Ser. No. 429,828, Jan. 2, 1974, abandoned.

[30] Foreign Application Priority Data

Dec. 30, 1972 [PL] Poland ..... 160079

[51] Int. Cl.[2] ..... C21D 1/74

[52] U.S. Cl. ..... 266/252

[58] Field of Search ..... 23/262, 277; 148/16, 148/16.6; 266/249, 252

[56] References Cited

FOREIGN PATENT DOCUMENTS 626123 7/1961 Canada ..... 266/252

795076 7/1958 United Kingdom ..... 266/252

*Primary Examiner*—Gerald A. Dost

*Assistant Examiner*—Paul A. Bell

*Attorney, Agent, or Firm*—Haseltine, Lake & Waters

[57] ABSTRACT

An installation for nitriding-sulphiding of steel and cast-iron articles including an enclosed tank, and a retort containing sulphur and placed in the interior of the tank. The retort is surrounded with a heating device. The tank is provided at its top with two pipe connectors. One connector is connected with the container of ammonia and the other connector is connected with the furnace for chemical and heat treatment of the articles. The ammonia flows from its container to the tank with a retort containing sulphur, wherefrom after being mixed with the vapors of sulphur, it flows out to the furnace in which the articles to be treated are placed. In the furnace at a temperature of 400°-700° C., the nitrogen and sulphur diffuse to the surface layer of the treated articles, thus producing the required sulphides in the nitrided layer.

3 Claims, 2 Drawing Figures

INSTALLATION FOR NITRIDING-SULPHIDIZING OF STEEL AND IRON ELEMENTS

This is a continuation of application Ser. No. 429,828 filed Jan. 2, 1974 now abandoned.

The invention relates to an installation designed for nitriding sulphiding steel and cast iron elements.

Heretofore, the nitriding sulphiding treatment of surfaces of machine elements was conducted in tanks containing melted cyanogen salts with additions of sulphur compounds. The required accessory equipment for the above mentioned treatment being the washing vats, driers, and also the equipment for neutralizing and pickling. An additional imperfection of conducting the nitriding sulphiding treatment in a bath is the need of keeping of a constant chemical composition of the bath. Trouble also arises from the fact that the air pollution produced during the treatment is highly toxic.

Also known are installations conducting the nitriding-sulphiding treatment in gas environment, these installations being the subject of theory studies. Installations of this type are in the form of heated vessels in which the elements are placed for treatment. These vessels are supplied with ammonia, nitrogen, carbon monoxide and steam. The fact that the hydrogen sulphide binds readily with the ammonia produces the ammonium sulphide which is a solid, lowers the efficiency of the treatment to such a degree, that installations of this type are hardly applicable for industrial purposes. An additional imperfection here is the fact that in practice it is impossible to prevent the hydrogen sulphide from escaping to the outside.

The object of the invention is to provide an installation comprising: an enclosed tank within which there is placed a retort containing sulphur. The retort is surrounded with a heating device, and the tank is provided at its top part with two connection pipes. One of the connection pipes is connected to a container of ammonia, and the other pipe is connected to a furnace in which the parts to be treated are placed.

The ammonia flows from its container to the tank, wherefrom, after being mixed with sulphur vapors, it flows out to the furnace in which the steel and cast-iron works are placed. In the furnace the nitrogen and the sulphur diffuse at the temperature of 400°–700° C. to the surface layer of treated elements, thus producing the required sulphides in the nitrided layer. The elements which are subjected to a heat and chemical treatment in the installation demonstrate coefficient of friction which is from two to five times lower than in the case of elements treated in installations of other types. At the same time, their fatigue strength is higher. These elements are not prone to seizing when cooperating with other elements, and they have greater resistance to wear as compared to elements treated in installation of other conventional types.

Figure 1:
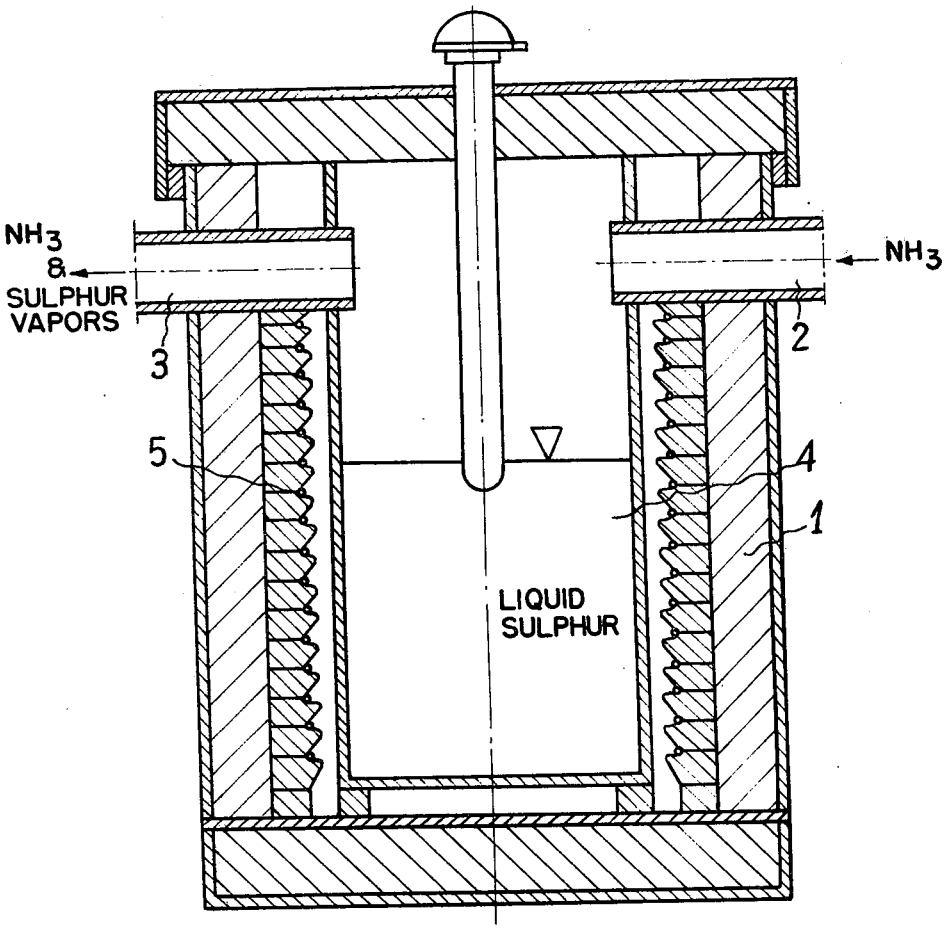
Figure 2:
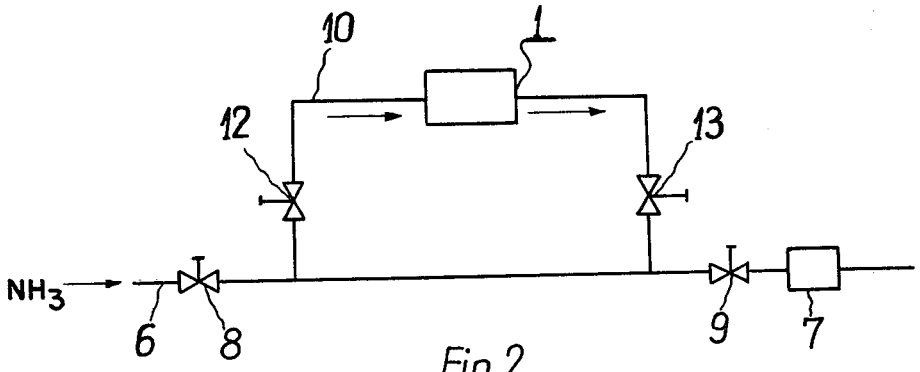

An embodiment of the invention will now be described by way of example with reference to the accompanying drawing in which FIG. 1 illustrates the installation in its longitudinal section, and FIG. 2 is a diagram of the furnace for heat and chemical treatment of steel and iron elements, the invented installation being installed in the said furnace.

The embodiment of FIG. 1 and FIG. 2 comprises an enclosed tank 1, which is provided at its top, with two pipe connectors 2 and 3. Pipe connector 2 connects the tank 1 with the pipe supplying the ammonia. Pipe connector 3 connects the tank 1 with the furnace 7 for the heat and chemical treatment. In the bottom of the tank 1 there is a retort 4 containing sulphur. The retort is surrounded with a heating device 5.

In a pipe 6, through which the ammonia is fed to a furnace 7, are mounted two valves 8 and 9. Valve 8 is installed before a branch 10, in which the tank 1 is connected. Valve 9 is installed behind branch 10. In the branch 10 there are two valves installed additionally. A valve 12 is installed before the tank 1, whereas a value 13 is installed behind the tank 1. The retort 4 is filled with sulphur. In the furnace 7 are placed all parts to be treated. Under influence of the heat provided by the heating device 5, the sulphur is melted. The ammonia flows through the pipes 6 and 10 to the tank 1 and mixes therein with the vapors of sulphur. Thereafter it flows to the furnace 7.

The flow of ammonia to the tank 1 is regulated by a suitable control valve 12 whereas the mass of ammonia flowing to the furnace 7 and mixed therein with sulphur vapors, is regulated by a suitable control valve 13.

Besides of regulation of flow, an additional regulation of heat expenditure of heating element 5 is provided.

The invented installation is suitable for use in the furnaces of all types where heat and chemical treatment is conducted by nitridizing.

Simple construction of the invented installation and low toxicity of used vapours of sulphur are additional praiseworthy qualities of this installation.

What we claim is:

1. An arrangement for nitriding-sulphiding of steel and cast-iron articles comprising an enclosed tank, a source of ammonia, a furnace in which said articles are placed, a closed retort containing an open vessel with liquid sulphur and placed in the interior of said tank, a heating device surrounding said retort, said retort having two pipe connectors at the top of said tank, one of said pipe connectors being connected with said source of ammonia for controlled supply of ammonia, said one pipe connector comprising an ammonia inlet for admitting ammonia from said ammonia source to said tank and to the interior of said retort, the other one of said pipe connectors being connected with said furnace in which articles to be treated are located for chemical and heat treatment of said articles, said other one of said pipe connectors conducting a mixture of ammonia and sulphur vapors from the tank, said other one of said pipe connectors comprising an outlet for said mixture and sulphur for conducting said mixture from the interior of said retort to said furnace and valve means in said other one of said pipe connectors for controlling the mass ratio of the mixture of ammonia and sulphur vapors conducted to said furnace and, wherein said ammonia inlet and mixture outlet are substantially at the top of said retort and communicating with the interior of said retort above the level of said liquid sulphur, said ammonia inlet and mixture outlet passing through the walls of said container and said tank.

2. The arrangement as defined in claim 1 including conduit means connected between said ammonia inlet and said mixture outlet, a first valve connected between said conduit means and said ammonia inlet, said first-mentioned valve means being connected between said mixture outlet and said conduit means, a second valve connected between said furnace and the junction of said first-mentioned valve means and said conduit means, and a third valve connected between said ammonia source and the junction of said first valve and said conduit means, said first valve regulating the flow of ammonia to the interior of said retort, the flow of mass mixture of ammonia and sulphur being regulated by said first-mentioned valve means.

3. The arrangement as defined in claim 2 wherein the temperature of said furnace is substantially within the range of 400°–700° C.

* * * * *